United States Patent [19]

Bandukwalla

[11] Patent Number: 4,877,373

[45] Date of Patent: Oct. 31, 1989

[54] VANED DIFFUSER WITH SMALL STRAIGHTENING VANES

[75] Inventor: Phiroze Bandukwalla, Olean, N.Y.

[73] Assignee: Dresser-Rand Company, Corning, N.Y.

[21] Appl. No.: 153,591

[22] Filed: Feb. 8, 1988

[51] Int. Cl.[4] ..... F04D 29/44

[52] U.S. Cl. ..... 415/208.4

[58] Field of Search ..... 415/181, 211, 219 A, 415/DIG. 1, 148

[56] References Cited

U.S. PATENT DOCUMENTS

| | | | |
|---|---|---|---|
| 1,047,663 | 12/1912 | Lawaczeck | 415/211 |
| 2,373,713 | 4/1945 | Shoults | 415/211 |
| 2,380,772 | 7/1945 | McMahan | 415/211 X |
| 2,739,782 | 3/1956 | White | 415/150 |
| 2,996,996 | 8/1961 | Jassniker | 415/157 |
| 3,079,127 | 2/1963 | Rowlett et al. | 415/158 |
| 3,156,407 | 11/1964 | Bourquard | 415/211 |
| 3,184,152 | 5/1965 | Bourquard | 415/211 X |
| 3,289,919 | 12/1966 | Wood | 415/157 |
| 3,424,372 | 1/1969 | Blattner et al. | 415/211 |
| 3,481,531 | 12/1969 | MacArthur et al. | 415/DIG. 1 X |
| 3,588,270 | 6/1971 | Boelcs | 415/160 |
| 3,746,462 | 7/1973 | Fukuda | 415/115 |
| 3,756,739 | 9/1973 | Boussuges | 415/161 |
| 3,781,128 | 12/1973 | Bandukwalla | 415/211 |
| 3,784,318 | 1/1974 | Davis | 415/158 |
| 3,861,826 | 1/1975 | Dean, Jr. | 415/211 |
| 4,008,010 | 2/1977 | Fauconnet | 415/158 X |
| 4,023,350 | 5/1977 | Hovan et al. | 60/39.5 |
| 4,056,330 | 11/1977 | Lieber | 415/155 X |
| 4,218,182 | 8/1980 | Tsunoda et al. | 415/205 |
| 4,292,807 | 10/1981 | Rannenberg | 415/158 X |
| 4,354,802 | 10/1982 | Nishida et al. | 415/211 X |
| 4,378,194 | 3/1983 | Bandukwalla | 415/49 |
| 4,395,197 | 7/1983 | Yoshinaga et al. | 415/211 |
| 4,403,914 | 9/1983 | Rogo et al. | 415/165 |
| 4,421,457 | 12/1983 | Yoshinaga et al. | 415/211 |
| 4,470,256 | 9/1984 | Palmer | 415/150 X |
| 4,544,325 | 10/1985 | Rogo et al. | 415/150 |
| 4,626,168 | 12/1986 | Osborne et al. | 415/211 |

FOREIGN PATENT DOCUMENTS

| | | | |
|---|---|---|---|
| 2135286 | 1/1973 | Fed. Rep. of Germany . | |
| 971224 | 1/1951 | France . | |
| 119411 | 10/1978 | Japan . | |
| 101299 | 6/1983 | Japan . | |
| 317623 | 1/1957 | Switzerland | 415/211 |
| 522343 | 9/1976 | U.S.S.R. . | |
| 524012 | 11/1976 | U.S.S.R. | 415/211 |
| 591695 | 2/1978 | U.S.S.R. | 415/DIG. 1 |
| 687264 | 9/1979 | U.S.S.R. | 415/211 |
| 2013280 | 8/1979 | United Kingdom | 415/211 |

OTHER PUBLICATIONS

Abdel-Hamid, "A New Technique for Stabilizing the Flow and Improving the Performance of Vaneless Radial Diffusers", Journal of Turbomachinery, vol. 109, pp. 36–40, Jan. 1987.

Abdelhamid, A. N., "Analysis of Rotating Stall in Vaneless Diffusers of Centrifugal Compressors", The American Society of Mechanical Engineers, Bulletin No. 80-GT-184, Mar. 1980.

Abdelhamid, A. N., "Effects of Vaneless Diffuser Geometry on Flow Instability in Centrifugal Compression Systems", The American Society of Mechanical Engineers, Bulletin 81-GT-10, Mar. 1981.

*Primary Examiner*—Robert E. Garrett

*Assistant Examiner*—Joseph M. Pitko

[57] ABSTRACT

An improved vaned diffuser includes primary and secondary curved vanes. The secondary vanes are located radially outward of the leading edges of the primaries. A plurality of secondary vanes is associated with each pair of first row vanes. The camber or curvature of the two rows is opposed. The camber of the second row vanes varies in accordance to the individual vane's proximity to a pressure surface of a primary vane. Flutes may be provided in the hub and shroud walls of the diffuser.

17 Claims, 2 Drawing Sheets

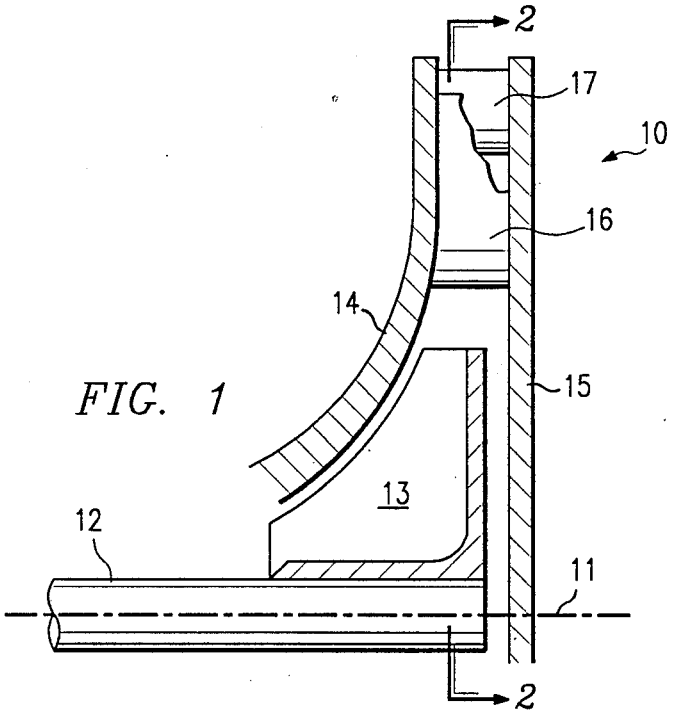
FIG. 1
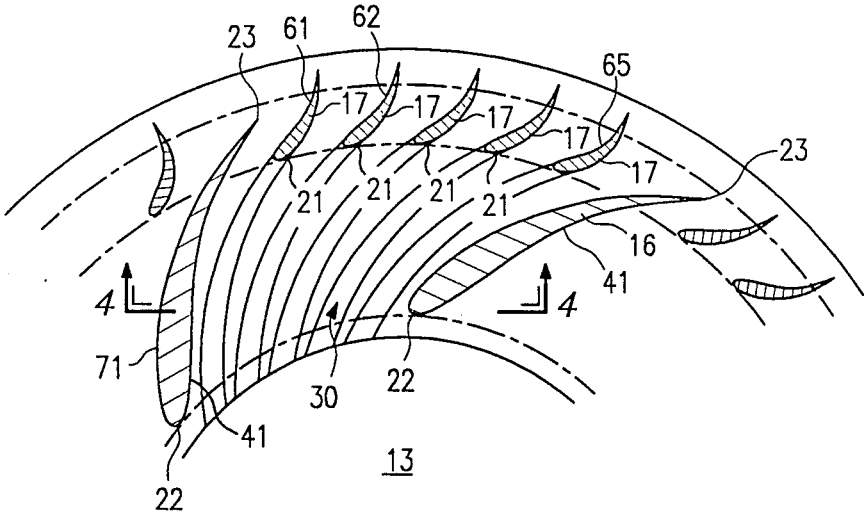
FIG. 2
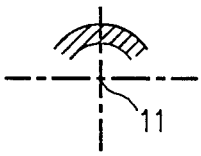

VANED DIFFUSER WITH SMALL STRAIGHTENING VANES

FIELD OF THE INVENTION

This invention pertains to a vaned diffuser, and more particularly to a vaned diffuser having small secondary flow straightening vanes near the diffuser exit.

BACKGROUND OF THE INVENTION

While both radial flow and uniform flow are desirable attributes of a diffuser output, neither is ordinarily obtained in prior art devices. Owing to strong logarithmic flow exiting the impeller, the flow tends to separate from the suction side of vanes in the diffuser and is likewise biased towards the pressure surface of the vanes. Even at the design mass flow point, prior art diffusers are characterized by turbulence and strong whirl at the exit.

Prior art remedies have included the provision of a second full size set of vanes, either radially outwardly from the first set or radially inwardly as in the case where said vanes are placed in the return channels of a multi-stage compressor after a right angle bend. These prior art solutions are generally ineffective because they must contend with a highly disturbed flow, or costly because full size vanes further increase the size of the diffuser.

SUMMARY OF THE INVENTION

The present invention is offered for the purpose of providing an improved diffuser structure which does not suffer from the deficiencies of the prior art. Accordingly, a diffuser having a row of primary curved vanes is provided with a row of secondary curved vanes radially outwardly from the leading edges of the primaries. Whereas the primary vanes are generally cambered like the log spiral core flow within the diffuser, the second row is curved in the opposite direction. In addition, flutes may be provided in the hub and shroud wall of the diffuser.

BRIEF DESCRIPTION OF THE DRAWINGS

FIG. 1 shows in cross section a diffuser of the present invention. A curved primary vane has been partially broken away to reveal a curved secondary vane.

FIG. 2 shows, in a cross section taken through the lines 2—2 of FIG. 1, the improved diffuser of the present invention.

DESCRIPTION OF THE PREFERRED EMBODIMENT

Figure 3:
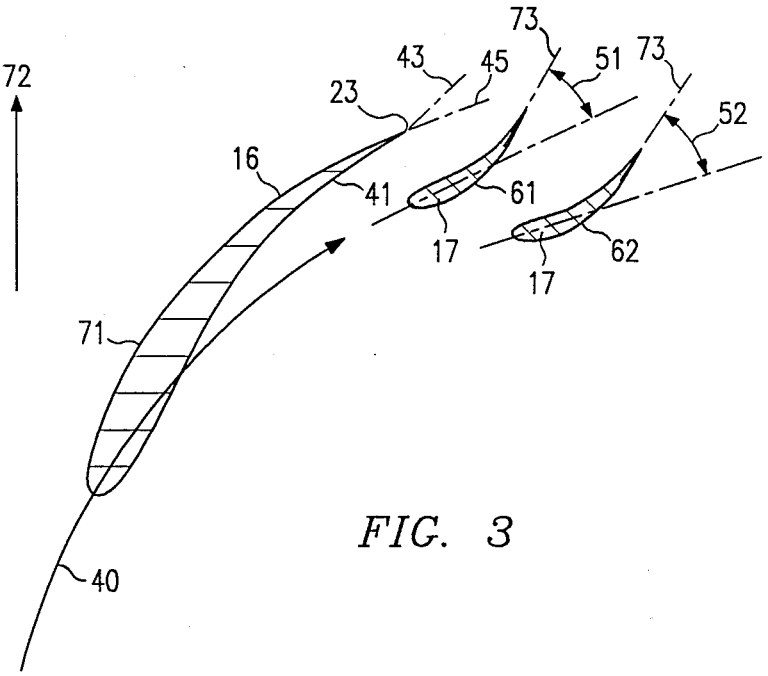
FIG. 3 shows in cross section a detail depicting one of the curved primary vanes and two of the curved secondary vanes.

As shown in FIG. 1, a centrifugal compressor has a central axis 11 about which turns a shaft 12 bearing an impeller 13. The improved diffuser 10 of the present invention comprises a shroud wall 14 and a hub wall 15. Between the hub wall and the shroud wall there extends a plurality of curved primary vanes 16 defining a primary row and a plurality of smaller secondary curved vanes 17 defining a secondary row. The primary vanes 16 are standard diffuser vanes. They act to deflect the flow in the diffuser from log spiral toward the radial direction.

Figure 4:
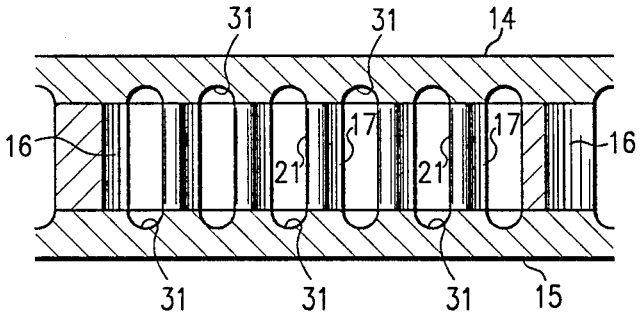
FIG. 4 shows in cross section, through lines 4—4 of FIG. 2, the fluted hub and shroud wall of the present invention.

As depicted in FIG. 2, the leading edges 21 of the secondary vanes lie radially outwardly from the leading edges 22 of the primary vanes and are radially inward of the trailing edges 23 of the primary vanes. In the example of FIG. 2, the leading edges 21 are significantly closer to the trailing edges 23 of the primary vanes than to the leading edges 22. As shown, a "set" of five smaller curved vanes in the second row lie between each pair of larger primary vanes. An optional feature of the present invention is the provision of flutes 30 between each pair of primary vanes. The flutes consist of shallow channels 31 which further aid in directing the flow within the diffuser toward the secondary vanes 17. The flutes follow the expected flow lines between the pressure surface 71 and suction surface 41 of adjacent first row vanes. As shown more clearly in FIG. 4, the flutes may be provided in both the shroud wall 14 and hub wall 15 of the diffuser. Depending on the machine tool used in the fabrication of the hub and shroud walls, the flutes may be rounded or square channels formed by the usual fabrication method, although a deeper than ordinary cut may be desired. A flute width to depth ratio of 2:1 is considered practical. Note that because the number of flutes 30 and secondary vanes 17 correspond, there is one more flute 30 than secondary vane. The flutes serve the dual functions of energizing boundary layer flow and redirecting the boundary flow toward the secondary vanes.

FIG. 3 illustrates more clearly the relationship between the primary vanes 16 and the secondary vanes 17. The primary vanes 16 are generally inclined toward the radial direction 72 with respect to the spiral flow 40. Each primary vane includes a suction surface 41 and pressure surface 71. The action of the secondary vanes 17 prevents separation that would normally occur adjacent the suction surface 41. The secondary vanes 17 induce a more favorable flow pattern between primary vane pairs.

The exit angle of the primary vane's suction surface 41 is defined as the angle between the tangent line 43 (at the trailing edge 23) and a radius at the trailng edge. The exit angle of the pressure surface 71 is defined as the angle between a tangent 45 to the pressure surface (at the trailing edge) and a radius at the trailing edge. Because the exit angles of the suction and pressure surfaces are different, the camber angles 51, 52, etc. of the second row vanes will vary. With reference to the example of FIG. 2, a first secondary vane 61 is less cambered than a second secondary vane 62 which is less cambered than a third secondary vane 63 etc. Notice that the trailing edge camber lines 73 of all secondary vanes point substantially in the radial direction.

Thus, in each set of secondary vanes, the camber increases from the second row vane nearest a suction surface to the second row vane nearest a pressure surface. This feature may be implemented regardless of the number of second row vanes between primary vane pairs, or not at all, if desired.

The basic function of the secondary vanes is to turn the flow towards the radial direction. The other function of the secondary vanes is to induce streamlined flow around the primary vanes (prevent separation). The function of the secondary vanes is enhanced by the fluting, if provided.

While the principles of the present invention have been described in connection with specific equipment, it is to be understood that this description is made by way of example and should not be considered a limitation to the scope of the accompanying claims.

What is claimed is:

1. In a diffuser having a first row of primary curved vanes, each of said primary curved vanes having a leading edge and a trailing edge, the improvement comprising:

a second row of secondary curved vanes which are smaller than said primary curved vanes, said second row being located radially outwardly from the leading edges of the first row of primary curved vanes, each of the secondary curved vanes having a leading edge located radially inwardly of the trailing edges of the primary curved vanes, each pair of adjacent primary curved vanes having a respective plurality of said secondary curves vanes positioned between the primary curved vanes of the respective pair, the camber of the secondary curved vanes opposing the camber of the primary curved vanes.

2. The improved diffuser of claim 1, wherein:

each of the secondary curved vanes has a preselected trailing edge camber angle which is substantially radially aligned.

3. In a diffuser having a first row of primary curved vanes, each of said primary curved vanes having a leading edge and a trailing edge, the improvement comprising:

a second row of secondary curved vanes located radially outwardly from the leading edges of the primary curved vanes of the first row, each of the secondary curved vanes in the second row having a leading edge located radially inwardly of the trailing edges of the primary curved vanes, the camber of the secondary curved vanes opposing the camber of the primary curved vanes, wherein the primary curved vanes further comprise a plurality of adjacent primary vane pairs;

each primary vane pair having therebetween a respective set of said secondary curved vanes; and each secondary curved vane in the respective set having a unique camber angle with respect to the other secondary curved vanes in the respective set.

4. The improved diffuser of claim 3 wherein:

each primary curved vane has a suction surface and a pressure surface; and the secondary curved vane adjacent the suction surface of a primary curved vane has a lower camber than the other secondary curved vanes in the set.

5. The improved diffuser of claim 4, wherein the camber of the secondary curved vanes in a set increases incrementally from that of said secondary curved vane adjacent to the suction surface of a primary curved vane to that of the secondary curved vane adjacent the pressure surface of a primary curved vane.

6. The improved diffuser of claim 3 wherein each of the secondary curved vanes further comprises a preselected trailing edge camber angle which is substantially radially aligned.

7. The improved diffuser of claim 6, wherein:

the diffuser further comprises a hub wall and a shroud wall, the hub and shroud walls having formed therein a fluted portion.

8. The improved diffuser of claim 3, wherein the leading edge of the secondary curved vanes are significantly closer to the trailing edges of the primary curved vanes than to the leading edges of the primary curved vanes.

9. The improved diffuser of claim 3, wherein each primary curved vane is generally inclined toward the radial direction with respect to a spiral flow of fluid into the diffuser.

10. In a diffuser categorized by a hub wall, a shroud wall and curved primary vane pairs located between the hub and shroud walls, the improvement comprising:

each primary vane pair having positioned therebetween a respective plurality of secondary vanes, the secondary vanes being located between the hub and shroud walls;

the secondary vanes each having a radially directed trailing edge camber angle; and the camber of the secondary vanes opposing the camber of the primary vanes.

11. The improved diffuser of claim 10, wherein:

the hub wall includes a plurality of flutes which are located between primary vanes;

the flutes following the flow path between primary vanes.

12. The improved diffuser of claim 11 wherein:

the number of flutes located between a respective primary vane pair, is one more than the number of secondary vanes positioned between said respective primary vane pair.

13. The improved diffuser of claim 12, wherein each flute is a shallow channel which aids in directing the flow within the diffuser toward the secondary vanes.

14. The improved diffuser of claim 13, wherein the width to depth ratio of each channel is about 2:1.

15. The improved diffuser of claim 13, wherein each primary vane is generally inclined toward the radial direction with respect to a spiral flow of fluid into the diffuser.

16. In a diffuser categorized by a hub wall, a shroud wall and curved primary vane pairs, the improvement comprising:

a respective plurality of secondary vanes positioned between each respective primary vane pair;

the secondary vanes each having a radially directed trailing edge camber angle;

the camber of the secondary vanes opposing the camber of the primary vanes;

the hub wall includes a plurality of flutes which are located between primary vanes, the flutes following the flow path between primary vanes;

the number of flutes located between a respective primary vane being one more than the number of secondary vanes positioned between said respective primary vane pair;

the plurality of secondary vanes between a respective primary vane pair defining a set; and the camber of the secondary vanes within a set varying with respect to position in that set.

17. The improved diffuser of claim 16, wherein each primary vane has a pressure surface and a suction surface, and wherein the camber of the secondary vanes in a set between a respective primary vane pair increases from that of the secondary vane nearest a suction surface to that of the secondary vane nearest a pressure surface.

* * * * *

UNITED STATES PATENT AND TRADEMARK OFFICE

CERTIFICATE OF CORRECTION

PATENT NO. : 4,877,373

DATED : October 31, 1989

INVENTOR(S) : Phiroze Bandukwalla

It is certified that error appears in the above-identified patent and that said Letters Patent is hereby corrected as shown below:

Column 4, line 52, after "vane" insert --pair--.

Signed and Sealed this

Twenty-eighth Day of May, 1991

*Attest:*

HARRY F. MANBECK, JR.

*Attesting Officer*

*Commissioner of Patents and Trademarks*